US007024702B2

(12) United States Patent
Kronenberger

(10) Patent No.: US 7,024,702 B2
(45) Date of Patent: Apr. 11, 2006

(54) HEADWEAR PIECE WITH CROWN OPENING

(76) Inventor: Ronald Kronenberger, 320 Portwine Rd., Riverwoods, IL (US) 60015

( * ) Notice: Subject to any disclaimer, the term of this patent is extended or adjusted under 35 U.S.C. 154(b) by 10 days.

(21) Appl. No.: 10/373,315

(22) Filed: Feb. 24, 2003

(65) Prior Publication Data

US 2004/0163157 A1 Aug. 26, 2004

(51) Int. Cl.
*A42B 1/24* (2006.01)

(52) U.S. Cl. ..... 2/209.3

(58) Field of Classification Search ..... 2/10, 2/12, 209.3, 175.4, 195.5; D2/871–873, D2/875, 876
See application file for complete search history.

(56) References Cited

U.S. PATENT DOCUMENTS 4,815,838 A * 3/1989 Liautaud ..... 351/158
5,321,854 A 6/1994 Kronenberger
5,325,540 A * 7/1994 Kronenberger ..... 2/209.3
5,659,896 A * 8/1997 Taylor ..... 2/12
5,727,251 A * 3/1998 Sherlock et al. ..... 2/15
6,240,566 B1 * 6/2001 Scantlin ..... 2/171
6,588,021 B1 * 7/2003 Kronenberger ..... 2/195.1

* cited by examiner

*Primary Examiner*—Katherine M. Moran
(74) *Attorney, Agent, or Firm*—Wood, Phillips, Katz, Clark & Mortimer

(57) ABSTRACT

A headwear piece having a crown with a peripheral wall which extends around the head of a wearer. The crown has a front, a rear, and a top, and a bottom. The peripheral wall has a front wall portion that projects upwardly to define a forwardly facing surface and is contiguous with a top wall portion that defines an upwardly facing surface having a substantial area to protect a wearer's head. The crown further has first and second spaced legs which project rearwardly and cooperatively and compressibly capture a wearer's head to maintain the headwear piece in an operative position on a wearer's head.

27 Claims, 6 Drawing Sheets

HEADWEAR PIECE WITH CROWN OPENING

BACKGROUND OF THE INVENTION

1. Field of the Invention

This invention relates to headwear pieces of the type having a crown with an opening to allow a wearer's hair to pass therethrough.

2. Background Art

The use of casual headwear continues to increase in many different environments and amongst a wider range of age groups. Headwear purveyors constantly seek out different headwear designs to meet consumer demands in terms of both aesthetics and function. One popular headwear design is the baseball-style cap. The baseball-style cap has an inverted, cup-shaped crown with a bottom rim surface that surrounds and embraces the head of a wearer. The crown has a peripheral wall with a forward wall portion that typically bears logos, ornamentation, etc. A brim/bill projects forwardly from the front wall portion and provides a shield against sun exposure, rain, snow, etc. at the wearer's face.

The baseball-style cap is commonly made with a size adjustment capability. Typically, the rear portion of the cap has elastic and/or a strap which can be reconfigured to vary the effective diameter of the inside surface of the bottom rim that engages the wearer's head. In one form, an inverted, U-shaped opening is provided at the rear of the crown to allow diameter reduction without bunching of the crown material in the region thereadjacent. The means by which this diameter adjustment is accomplished vary widely. As one example, joinable strap portions are commonly utilized which can be mated in different manners to select a combined length which is associated with a particular crown diameter. The connection of the strap parts may be accomplished through the use of mating, Velcro®-type fastener parts, cooperating studs and receptacles, snaps, buckles, etc.

Baseball-style caps are frequently worn by men and women with long hair. A wearer with long hair has different options as to how the baseball-style cap may be worn. As one option, the wearer's hair can be accumulated and tucked into the top of the crown. This may not be practical depending upon the length of the hair. As another option, the hair may be accumulated at the rear of the wearer's head and projected outwardly at the rear of the headwear piece between the rim and the wearer's head. This may lead to a localized pressure application on the wearer's head in the vicinity of where the hair is accumulated.

The latter problem lead to the design, by the assignee hereof, of a headwear piece with a crown opening situated to allow an accumulation of the wearer's hair to be directed outwardly through the crown opening so that the fit of the headwear piece is essentially unaffected by the mass of hair. This design is shown in U.S. Pat. No. 5,321,854. With this design, the front of the headwear piece retains the appearance of a conventional baseball-style cap and at the same time conveniently accommodates a wearer's hair, regardless of its length.

With the design as shown in U.S. Pat. No. 5,321,854, the headwear piece may either be a single size or an adjustable size design. In the former case, the crown material can extend continuously around the crown opening as one piece. Alternatively, the aforementioned arrangement of adjusting straps can be utilized and maintained together with cooperating Velcro®-type fasteners, studs, snaps, buckles, etc. Depending upon its nature, the adjusting structure on the straps may cause an inconvenience to the wearer with long hair. The problem may arise in the event that the adjustment is attempted with the headwear piece in a preliminary wearing position. With the hair accumulated and directed through the crown opening, the strap parts can be joined to select the desired effective cap diameter that is comfortable to the wearer. However, the wearer's hair may find its way between the strap parts and potentially become snagged, as on the Velcro®-type fastener parts, between the snaps, studs, buckle etc. This problem is actually contended with with all adjustable size, baseball-style caps, regardless of the length of the wearer's hair.

One existing headwear piece design that avoids the above problem is commonly sold in a visor configuration that is "clipped on"the wearer's head. These visors incorporate a U-shaped element which is oriented to open rearwardly with respect to the wearer's head and to embrace the wearer's head. This design offers the wearer the convenience of initially simply spreading the legs of the U-shaped element sufficiently to introduce the head therebetween and thereafter releasing the legs so that they spring back and firmly embrace the wearer's head. This visor configuration is designed to accommodate potentially a significant range of head sizes.

While the above visor design has been popular, it offers a uniquely different appearance than the baseball-style cap. The visor typically has a crown segment with a front wall portion that projects upwardly to a free edge. The front wall typically does not have a significant vertical extent. With the above design, the crown segment tends not to maintain a predetermined shape and is prone to irregular folding or bunching up at the front of the visor.

The visor design, described above, has a number of other drawbacks compared with a baseball-style cap. As noted above, whereas the visor may have a relatively random appearance as viewed from the front thereof, the crown of the baseball-style cap has a consistent, identifiable shape, consisting of a sizable front wall projecting upwardly and angularly rearwardly. The shape of this front wall is maintained by the continuation of the front wall to the side walls, which in turn are contiguous with a top wall portion so that the shape of the front region of the baseball-style cap is consistently predetermined, albeit reshapable.

Another drawback with the visor is that it does not offer a surface area of consistent size and shape to allow the placement of certain informational material and decoration. Baseball caps on the other hand afford a relatively large, forwardly facing surface to accommodate the placement of information, such as team logos, ornamentation, etc.

Still further, the above visor design does not provide any significant shielding to the wearer's head beyond the brim/bill. Thus, the only significant shielding effect is that which is afforded by the brim/bill.

SUMMARY OF THE INVENTION

In one form, the invention is directed to a headwear piece having a crown with a peripheral wall which extends around the head of a wearer. The crown has a front, a rear, and a top, and a bottom. The peripheral wall has a front wall portion that projects upwardly to define a forwardly facing surface and is contiguous with a top wall portion that defines an upwardly facing surface having a substantial area to protect a wearer's head. The crown further has first and second spaced legs which project rearwardly and cooperatively and compressibly capture a wearer's head to maintain the headwear piece in an operative position on a wearer's head.

In one form, the first and second spaced legs are defined by a single piece.

The single piece may have an overall U shape which opens rearwardly.

The single piece may be made from a hard plastic material.

In one form, the crown has a front wall portion and spaced side wall portions projecting rearwardly from the front wall portion. The front and side wall portions each have an upwardly extending surface. The crown further has a top wall portion which bridges the side wall portions and defines an upwardly facing surface.

In one form, the headwear piece has a brim/bill connected to and projecting forwardly from the crown.

The front, top, and side wall portions and brim/bill may cooperate to form a shape-retentive region at the front of the headwear piece.

In one form, the crown has a peripheral shape as viewed from the top of the headwear piece and an opening. The opening is at least one fifth the area of the peripheral shape as viewed from the top of the headwear piece.

In one form, the area of the opening is at least one third the area of the peripheral shape as viewed from the top of the headwear piece.

In one form, the top wall portion has a rear edge, with the rear edge extending from the front of the crown at least one third of the distance between the front and the rear of the crown.

The rear edge may extend from the front of the crown at least one half of the distance between the front and rear of the crown.

In one form, the crown is defined by a plurality of joined cloth gores.

A cloth material may surround at least a portion of at least one of the spaced legs.

In one form, a sweat absorbing material is applied to at least one of the spaced legs.

In one form, a button is applied to the top wall portion of the crown. The button projects upwardly a substantial distance from the upwardly facing surface of the crown.

The invention is further directed to a headwear piece having a crown with a peripheral wall which extends around the head of a wearer. The crown has a front, a rear, a top, and a bottom. A brim/bill projects forwardly from the crown. The peripheral wall has a front wall portion, spaced side wall portions, and a top wall portion. The brim/bill and peripheral wall are joined together so that the brim/bill and front, top and side wall portions cooperate to produce a shape-retentive region at the front of the headwear piece that appears as a baseball-style cap as viewed from the front of the headwear piece. The peripheral wall is interrupted at the rear of the peripheral wall so that the peripheral wall does not extend continuously around the wearer's head with the headwear piece in an operative position on a wearer's head.

In one form, the crown has first and second spaced legs which project rearwardly and cooperatively and compressibly capture a wearer's head to maintain the headwear piece in an operative position on a wearer's head.

The first and second spaced legs may be defined by a single, U-shaped piece.

In one form, the crown has a peripheral shape as viewed from the top of the headwear piece and an opening. The area of the opening is at least one fifth the area of the peripheral shape as viewed from the top of the headwear piece.

In one form, the top wall portion has a rear edge, with the rear edge extending from the front of the crown at least one third of the distance between the front and rear of the crown.

The invention is further directed to a headwear piece having a crown with a peripheral wall extending around the head of a wearer. The crown has a front, a rear, a top and a bottom. The peripheral wall has a front wall portion that projects upwardly to define a forwardly facing surface and is contiguous with a top wall portion that defines an upwardly facing surface having a substantial area to protect a wearer's head. A brim/bill projects forwardly from the crown. The peripheral wall is interrupted at the rear of the peripheral wall so that the peripheral wall does not extend continuously around a wearer's head with the headwear piece in an operative position on the wearers head.

In one form, the crown has first and second spaced legs which project rearwardly and cooperatively and compressibly capture a wearer's head to maintain the headwear piece in an operative position on the wearer's head.

The first and second spaced legs may be defined by a single, U-shaped piece.

In one form, the crown has a peripheral shape as viewed from the top of the headwear piece and an opening. The area of the opening is at least one fifth the area of the peripheral shape as viewed from the top of the headwear piece.

In one form, the top wall portion has a rear edge, with the rear edge extending from the front of the crown at least one third of the distance between the front and rear of the crown.

DETAILED DESCRIPTION OF THE DRAWINGS

Figures 1, 2:
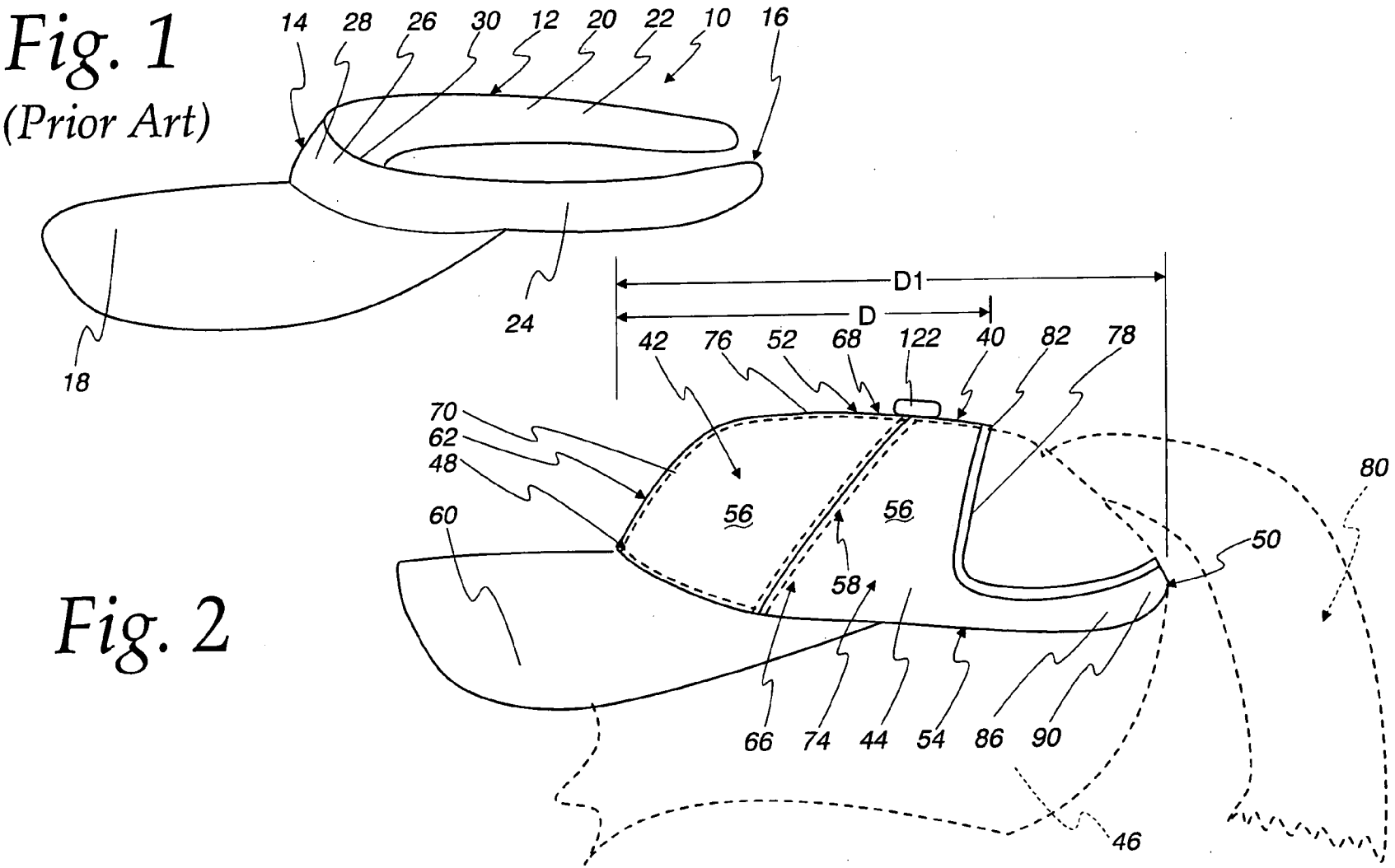
Fig. 1 (Prior Art)
FIG. 1 is a perspective view of a conventional visor.
FIG. 2 is a side elevation view of a headwear piece, according to the present invention, and shown in an operative position on a wearer's head and with the wearer's hair accumulated and directed out of a rear opening in a crown on the headwear piece.

Referring initially to FIG. 1, a conventional headwear piece, in the form of a visor, is shown at 10. The headwear piece/visor 10 consists of a crown 12 with a front 14 and rear 16. A brim/bill 18 projects forwardly from the front 14 of the crown 12.

The crown 12 is in the form of a U-shaped band having an inside surface 20 which embraces a wearer's head to maintain the headwear piece/visor 10 in an operative position on the wearer's head. The crown 12 has spaced legs 22, 24 which are bendable and cooperatively compressibly capture the wearer's head to maintain the headwear piece visor 10 in an operative position on the wearer's head.

As previously noted in the Background Art section herein, the crown 12 has a front wall portion 26 with a surface 28 that projects upwardly to a top edge 30. The surface 28 has a relatively short vertical extent which limits its suitability to accept information and ornamentation to be applied thereto.

Figure 3:
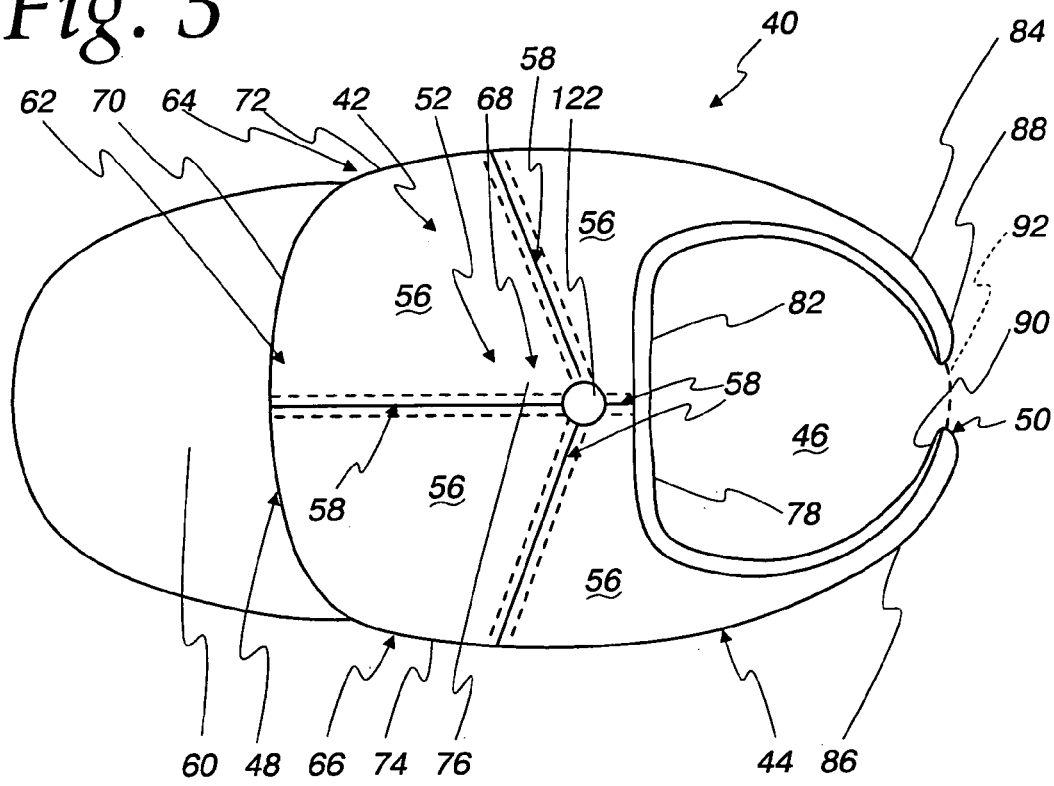
FIG. 3 is a plan view of the headwear piece in FIG. 2 in an operative position on a wearer's head.

Referring to FIGS. 2 and 3, one form of headwear piece, according to the present invention, is shown at 40. The headwear piece 40 consists of a crown 42 with a peripheral wall 44 that extends around the head 46 of a wearer. The crown 42 has a front 48, a rear 50, a top 52, and a bottom 54. The crown 42 is defined by a plurality of cloth gores 56, joined to each other along sewn seams 58, to produce the shape shown. A brim/bill 60 is connected to, and projects forwardly from, the crown 42.

The crown 42 has a front wall portion 62 which blends into spaced side wall portions 64, 66, which extend rearwardly therefrom. A top wall portion 68 is contiguous with the front wall portion 62 and spans between the side wall portions 64, 66. The brim/bill 60 is joined to the bottom of the front and side wall portions 62, 64, 66 in such a manner as to form a shape-retentive region at the front of the headwear piece 40 which appears as a conventional baseball-style cap, as viewed from the front of the headwear piece 40. With this shape, the front and side wall portions 62, 64, 66 have upwardly extending surfaces 70, 72, 74 which converge to an upwardly facing surface 76 on the top wall portion 68. While this construction produces a shape-retentive front region, the front region is reconfigurable in the same manner as a conventional baseball-style cap.

According to the invention, an opening 78 is formed in the rear region of the headwear piece 40. The opening 78 is sufficiently large to allow an accumulation of hair 80 at the rear of the wearer's head 46 to be projected therethrough with the headwear piece 40 in the operative position on the wearer's head 46. The opening 78 is bounded by a rear edge 82 on the top wall portion 68. The edge 82 extends downwardly to spaced crown legs 84, 86. The crown legs 84, 86 project rearwardly in cantilevered fashion and terminate at first and second free ends 88. 90. As shown in FIG. 3, the free rear ends 88, 90 are toed slightly inwardly. This configuration allows the legs 84, 86 to conform generally to the rear 92 of the wearer's head 46. The legs 84, 86 are spaced from each other so that with the headwear piece in an operative position on the wearer s head 46, the legs 84, 86 cooperatively and compressibly capture the wearer's head 46 to frictionally maintain the headwear piece in an operative position on the wearer's head 46. By having the legs 82, 84 slightly curved as shown in FIGS. 2 and 3, and toed in at the rear ends 88, 90, the legs 84, 86 tend to squeeze the wearer's head 46 so as to urge the headwear piece 40 rearwardly thereon so that front wall portion 62 is urged towards an abutting relationship with the front of the wearer's head 46.

The rear leg ends 88, 90 are spaced from each other so that the peripheral wall 44 does not extend continuously around the wearer's head 46. Accordingly, the wearer can either direct the headwear piece 40 downwardly into the operative position or rearwardly by slightly bending the legs 84, 86 to allow passage of the wearer's head 46 therebetween. Once the deforming pressure on the legs 84, 86 is released, the legs 84, 86 are urged back towards their undeformed state so that there is a residual bias force applied to the wearer's head to positively hold the headwear piece 40 in the operative position thereon. Since the legs 84, 86 need not connect at the rear ends 88, 90, no fastening material or structure is required as might cause hangup with the wearer's hair. At the same, a range of head sizes can be accommodated by a single configuration.

Figure 4:
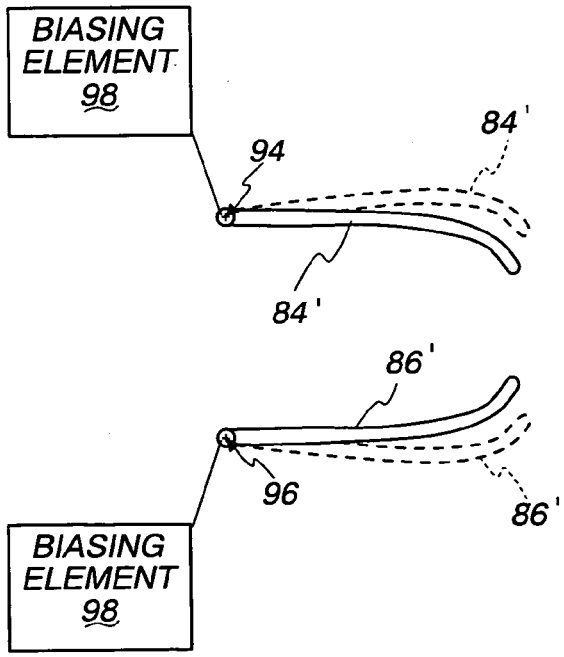
FIG. 4 is a partially schematic, reduced, plan view of legs that can be used on the inventive headwear piece in FIGS. 2 and 3 to cooperatively and compressibly embrace a wearer's head with the headwear piece in an operative position thereon.

The legs 84, 86 can be defined in many different manners. For example, as shown in FIG. 4, the legs 84', 86' are shown hinged for pivoting about axes 94, 96 relative to a portion of the crown. The legs 84', 86' can be pivoted from the solid line position to the dotted line position in FIG. 4 to allow placement of the headwear piece and can then be released to be returned to the solid line position as by biasing elements 98.

Figure 5:
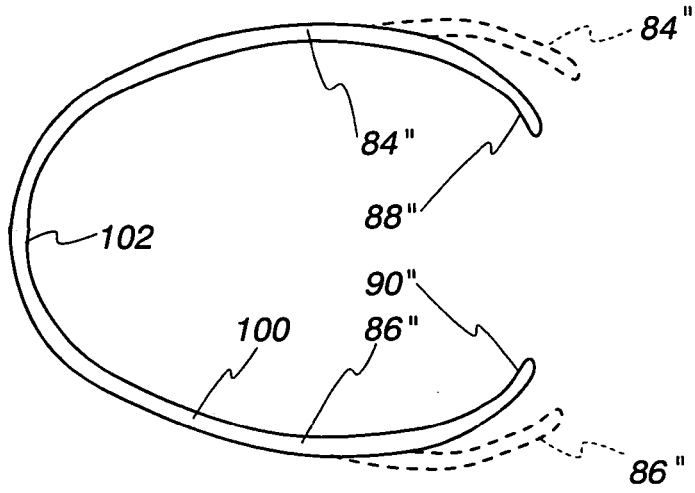
FIG. 5 is a plan view of a U-shaped piece which can be used as an alternative to the construction shown in FIG. 4 to define head embracing legs for maintaining the inventive headwear piece in an operative position on a wearer's head.

Alternatively, the crown legs may be defined by a single, U-shaped element, as shown at 100 in FIG. 5. The U-shaped element 100 has a bight portion 102 from which integral, spaced legs 84", 86" project. The bight portion 102 may be conformed to the shape of the front of the crown 42 so as to enhance the shape-retentive nature of the crown 42 at the front region thereof. The legs 84", 86" have rear ends 88", 90" which are slightly toed in toward the rear thereof. The U-shaped element 100 may be made from a hard plastic or other suitable material that is shape-retentive and which can be deformed to allow movement of the legs 84", 86" away from each other, to the dotted line position in FIG. 5, to facilitate placement and removal of the headwear piece 40.

Figure 6:
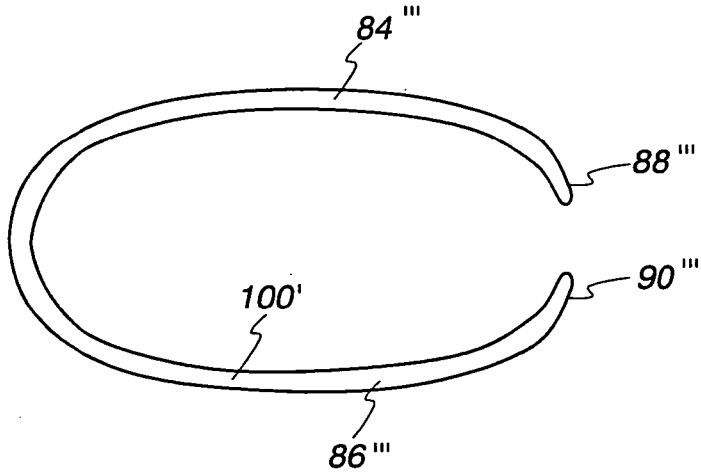
FIG. 6 is a view as in FIG. 5 of a modified form of U-shaped piece.

In FIG. 6, an alternative form of U-shaped element is shown at 100' that has legs 84''', 86''' that are more gradually curved and have more sharply bent free ends 88''', 90''' intended to wrap around the rear 92 of the wearer's head 46. This arrangement produces a more positive captive fore-and-aft relationship between the front and rear of the U-shaped element 100 and the wearer's head 46.

Figure 7:
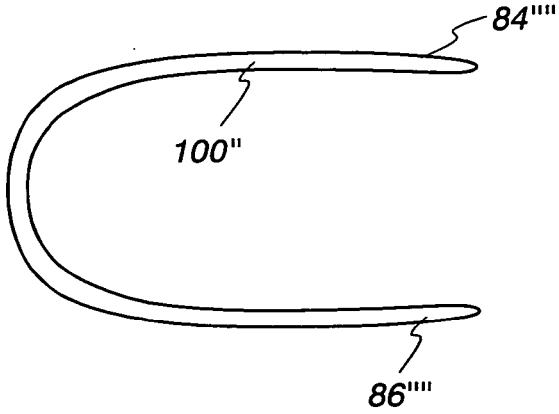
FIG. 7 is a view as in FIGS. 5 and 6 of a still further modified form of U-shaped piece, according to the present invention.

In FIG. 7, a further form of U-shaped element is shown at 100". The U-shaped element 100" has legs 84"", 86"" which project substantially parallel to each other. The legs 84"", 86"" function in the same manner as those described above but are not configured to wrap around the rear 92 of a wearer's head 46. However, the same compressive, captive, holding force can be generated against the wearer's head 46.

Other means for producing the spaced crown legs 84, 86 are contemplated. All that is required is that a captive force be produced by the legs 84, 86 on the wearer's head 46 sufficient to maintain the same in an operative position thereon.

Figure 8:
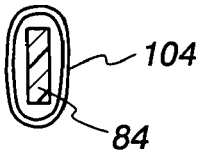
FIG. 8 is an enlarged, cross-sectional view of one of the head embracing legs on the inventive headwear piece surrounded by a cloth layer.

The legs 84, 84', 84", 84''', 84"", 86, 86', 86", 86''', 86"" can each be made from hard plastic material as shown for the exemplary leg 84 in FIG. 8. The leg 84 has a rectangular cross-sectional configuration. The leg 84 may be surrounded by a cloth material 104 for aesthetic reasons and so that a portion of the cloth 104 that contacts the wearer's head 46 may perform a sweat absorbing function.

Figure 9:
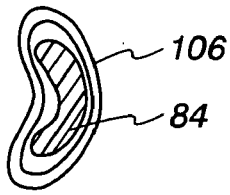
FIG. 9 is a view as in FIG. 8 of a modified form of leg.

In FIG. 9, the leg 84 is shown with a U-shaped cross section, which enhances rigidity and resistance to bending. The leg 84 in FIG. 9 is likewise shown surrounded by a cloth material 106 along a part of the, or the entire, length thereof.

Figure 10:
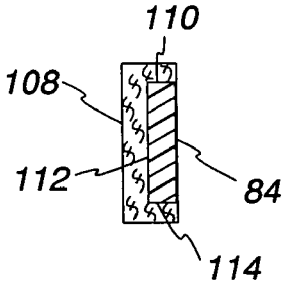
FIG. 10 is a view as in FIGS. 8 and 9 of a further modified form of leg, according to the present invention.

In FIG. 10, an alternative construction for the legs is shown for exemplary leg 84. The leg 84 has the same shape as shown in FIG. 8 and has a sweat absorbing cloth 108 extending around less than the entire periphery thereof. In this particular embodiment, the cloth layer 108 is adhered to three sides 110, 112, 114 of the leg 84.

Figure 11:
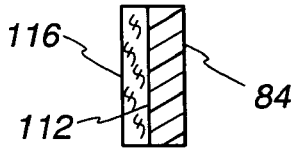
FIG. 11 is a view as in FIGS. 8–10 of a still further modified form of leg, according to the present invention.

In FIG. 11, a similar leg 84 is shown with a moisture absorbing cloth at 116 applied on only the one surface 112 thereof that is intended to contact the wearer's head 46.

Figure 12:
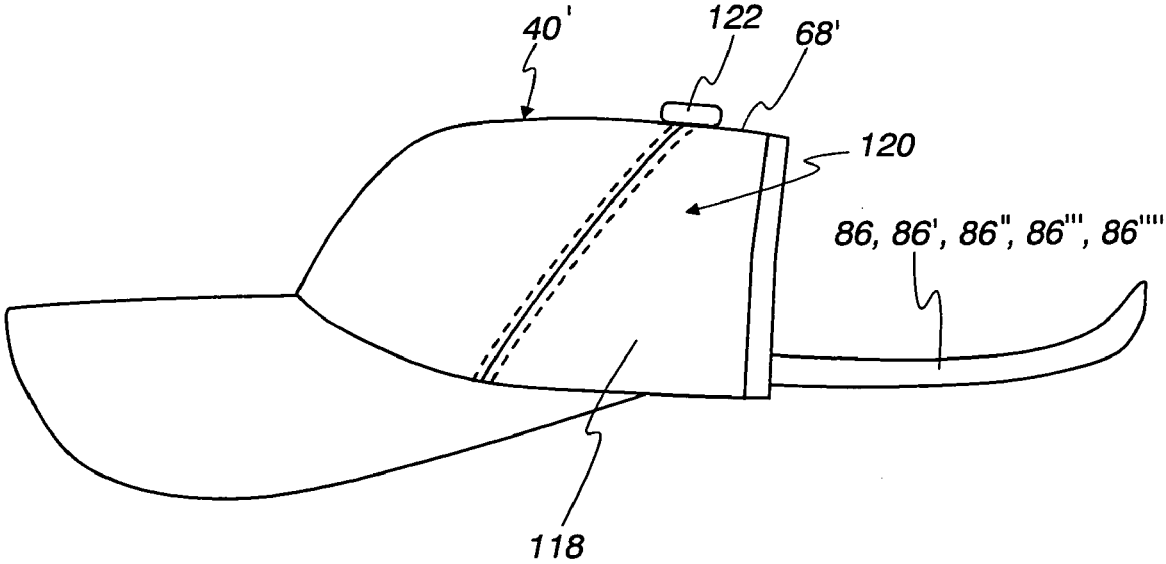
FIG. 12 is a view as in FIG. 2 of modified form of headwear piece, according to the present invention, wherein head embracing legs are not fully covered by cloth.

The configuration shown in FIGS. 10 and 11 may be utilized when the legs 84 are not covered by the same cloth 118, or fully by the same cloth 118, which defines the forward portion 120 of the headwear piece 40', as seen for example in FIG. 12.

The size of the opening 78 may vary over a significant range. In one example, as viewed from the top of the headwear piece 40, as shown in FIG. 3, the opening 78 may have an area equal to one fifth to one half the area of the peripheral shape of the entire crown, viewed from the same perspective. More preferably, the area of the opening 78 is from one fifth to one third of the area of the overall peripheral shape of the crown 42.

Figure 13:
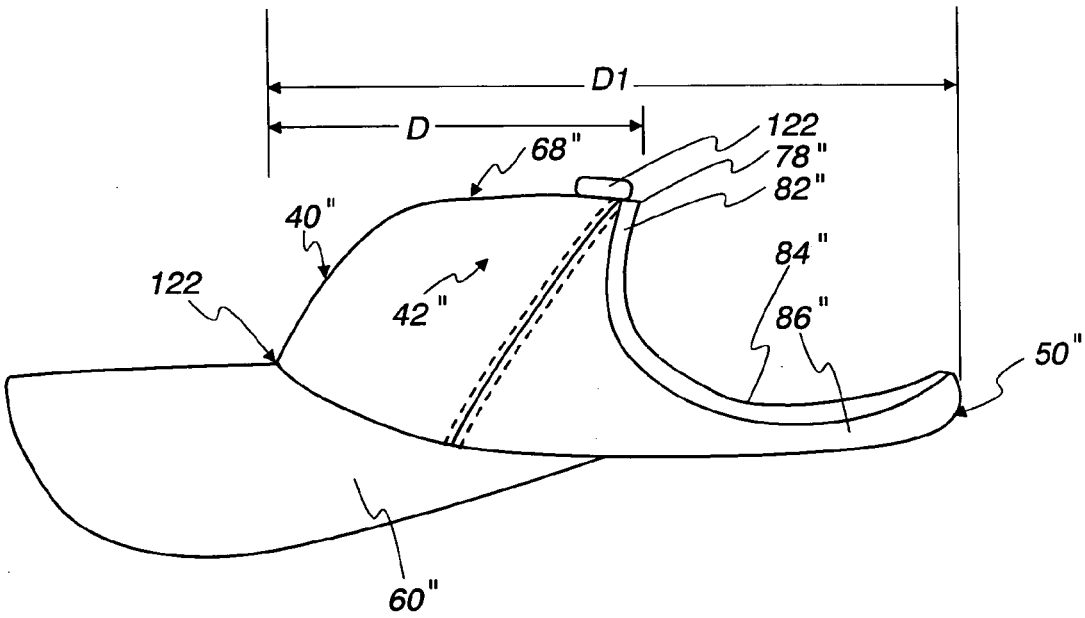
FIG. 13 is a view as in FIG. 2 of another modified form of headwear piece, according to the present invention, with a different configuration of opening in the crown.

To maintain the baseball-style cap appearance and certain of its shielding function, it is desirable that the top wall portion 68 extend a significant distance in a fore-and-aft direction. As shown in FIG. 13, a modified form of headwear piece 40" is shown with the same basic construction as the headwear piece 40, however with a lesser front to rear extent for the top wall portion 68". As shown in FIG. 13, the rear edge 78" extends from the front of the crown a distance D. The measurement is taken from a front point at 122, which represents the frontmost point of connection between the crown 42" and the brim/bill 60". The distance D extends from the point 122 rearwardly a distance D that is preferably equal to, or slightly greater than, one half the distance D1 from the point 122 to the rear 50" of the crown 42". A distance D equal to as little as one third the dimension D1 is also contemplated by the invention. The actual rear point for the dimension D1 is the point intended to coincide approximately with the rear of the wearer's head that would be wrapped around by the legs 84", 86" were they extended to connect to each other. Preferably, D does not exceed two thirds of the overall dimension D1. In FIG. 13, the distance D is on the order of one half the distance of D1, whereas in FIG. 2, the corresponding dimension D is substantially greater.

The edge 82 may extend substantially vertically to the legs 84, 86, as shown in FIG. 2. Alternatively, the edge 82" may progressively curve and blend into the legs 84", 86", as shown in FIG. 13.

To more accurately simulate the appearance of a conventional baseball-style cap, a button 122 is secured in conventional manner to the top wall portion 68, 68', 68".

Figure 14:
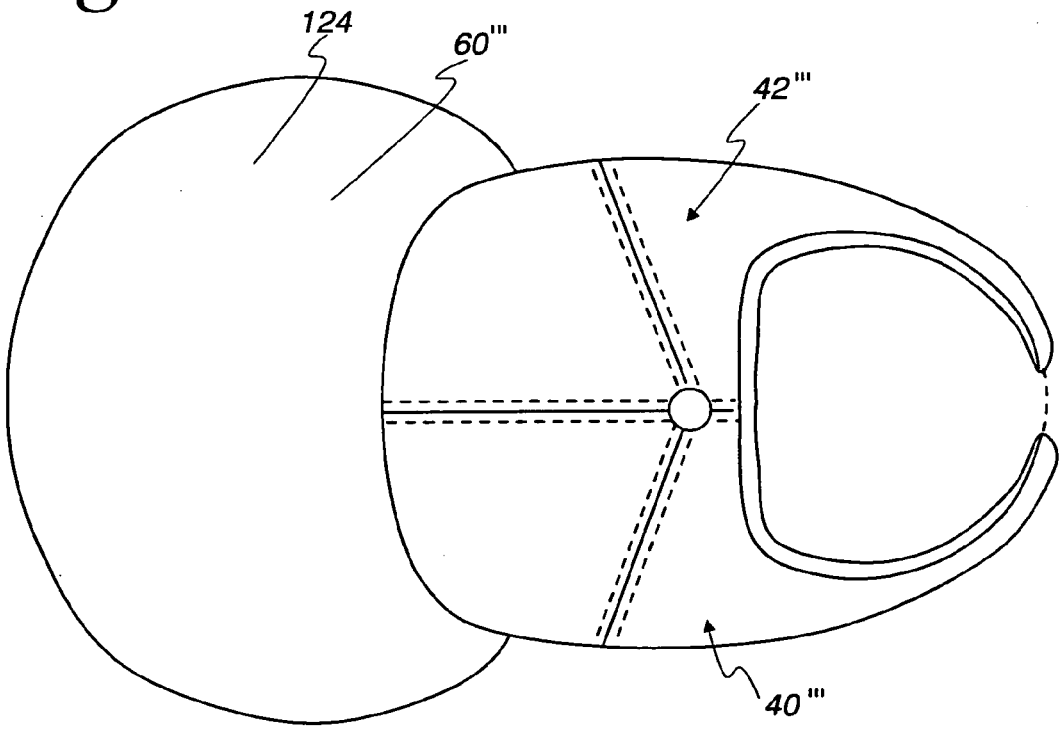
FIG. 14 is a view as in FIG. 3 of a further modified form of headwear piece, according to the present invention, with a different configuration of brim/bill.

As shown in FIG. 14, a modified form of headwear piece 40''', according to the present invention, can be made with a crown 42''' as shown in any of the embodiments previously described, with a brim/bill 60''' having a significantly larger upwardly facing surface 124. This larger brim/bill 60''' is common to the construction of women's visors.

Figure 15:
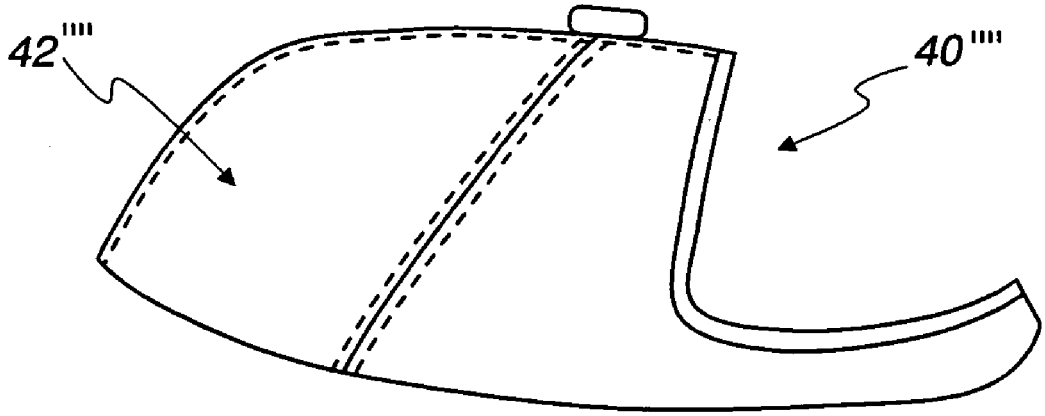
FIG. 15 is a view as in FIG. 2 of a still further modified form of headwear piece, according to the present invention, without a brim/bill.

A further modification of the present invention is shown in FIG. 15 at 40''''. The headwear piece 40'''' has a crown 42'''', corresponding to the crowns in any of the previously described embodiments. However, the headwear piece 40'''' is shown without a brim/bill projecting forwardly from the crown 42''''.

The foregoing disclosure of specific embodiments is intended to be illustrative of the broad concepts comprehended by the invention.

What is claimed is:

1. A headwear piece comprising:

a crown having a peripheral wall which extends around the head of a wearer, the crown having a front, a rear, a top and a bottom, the peripheral wall comprising a front wall portion that projects upwardly to define a forward facing surface and is contiguous with a top wall portion that defines an upwardly facing surface having a substantial area to protect a wearer's head, the crown further comprising first and second spaced legs which project rearwardly and cooperatively and compressibly capture a wearer's head to maintain the headwear piece in an operative position on a wearer's head, the first and second spaced legs projecting rearwardly to first and second free ends that are not connected, or connectable, to each other at the rear of the headwear piece wherein no part of the headwear piece extends, or is extendable, continuously around the headwear piece on a wearer's head.

2. The headwear piece according to claim 1 wherein the first and second spaced legs are defined by a single piece.

3. The headwear piece according to claim 2 wherein the single piece has an overall U shape which opens rearwardly.

4. The headwear piece according to claim 3 wherein the single piece is made from a hard plastic material.

5. The headwear piece according to claim 1 wherein the crown has a front wall portion and spaced side wall portions extending rearwardly from the front wall portions, the front and side wall portions each having an upwardly extending surface, the crown further having a top wall portion which bridges the side wall portions and defines an upwardly facing surface.

6. The headwear piece according to claim 5 wherein the headwear piece further comprises a brim/bill connected to and projecting forwardly from the crown.

7. The headwear piece according to claim 6 wherein the front, top, and side wall portions and brim/bill cooperate to form a shape-retentive region at the front of the headwear piece.

8. The headwear piece according to claim 1 wherein the crown has a peripheral shape as viewed from the top of the headwear piece and an opening, and the area of the opening is at least one fifth the area of the peripheral shape as viewed from the top of the headwear piece.

9. The headwear piece according to claim 8 wherein the area of the opening is at least one third the area of the peripheral shape as viewed from the top of the headwear piece.

10. The headwear piece according to claim 1 wherein the top wall portion has a rear edge and the rear edge extends from the front of the crown at least one third of the distance between the front and rear of the crown.

11. The headwear piece according to claim 10 wherein the rear edge extends from the front of the crown at least one half of the distance between the front and rear of the crown.

12. The headwear piece according to claim 1 wherein the crown comprises a plurality of joined cloth gores.

13. The headwear piece according to claim 12 wherein a cloth material surrounds at least a portion of at least one of the spaced legs.

14. The headwear piece according to claim 1 wherein a sweat absorbing material is applied to at least one of the spaced legs.

15. The headwear piece according to claim 1 wherein there is a button applied to the top wall portion of the crown, the button projecting upwardly a substantial distance from the upwardly facing surface.

16. A headwear piece comprising:

a crown having a peripheral wall which extends around the head of a wearer, the crown having a front, a rear, a top, and a bottom; and a brim/bill projecting forwardly from the crown, the peripheral wall comprising a front wall portion, spaced side wall portions and a top wall portion, the brim/bill and peripheral wall joined together so that the brim/bill and front, top and side wall portions cooperate to produce a shape-retentive region at the front of the headwear piece that appears as a baseball-style cap as viewed from the front of the headwear piece, the peripheral wall interrupted at the rear of the peripheral wall so that no part of the crown extends, or can be connected to extend, continuously around a wearer's head with the headwear piece in an operative position on a wearer's head, wherein no part of the /headwear piece extends, or is extendable, continuously around the head of a wearer so as to embrace a wearer's head to maintain the headwear piece on a wearer's head.

17. The headwear piece according to claim 16 wherein the peripheral wall extends around the sides of a wearer's head to compressibly engage the rear of the wearer's head with the headwear piece in the operative position.

18. A headwear piece comprising:

a crown having a peripheral wall which extends around the head of a wearer, the crown having a front, a rear, a top, and a bottom; and a brim/bill projecting forwardly from the crown, the peripheral wall comprising a front wall portion, spaced side wall portions and a top wall portion, the brim/bill and peripheral wall joined together so that the brim/bill and front, top and side wall portions cooperate to produce a shape-retentive region at the front of the headwear piece that appears as a baseball-style cap as viewed from the front of the headwear piece, the peripheral wall interrupted at the rear of the peripheral wall so that no part of the crown extends continuously around a wearer's head with the headwear piece in an operative position on a wearer's head, wherein the crown comprises first and second spaced legs which project rearwardly and cooperatively and compressibly capture a wearer's head to maintain the headwear piece in an operative position on a wearer's head, the first and second spaced legs projecting rearwardly to first and second free ends that are not connected, or connectable, to each other at the rear of the headwear piece wherein no part of the headwear piece extends, or is extendable, continuously around the head of a wearer so as to embrace a wearer's head to maintain the headwear piece on a wearer's head.

19. The headwear piece according to claim 18 wherein the first and second spaced legs are defined by a single, U-shaped piece.

20. The headwear piece according to claim 18 wherein the crown has a peripheral shape as viewed from the top of the headwear piece and an opening, and the area of the opening is at least one fifth the area of the peripheral shape as viewed from the top of the headwear piece.

21. The headwear piece according to claim 18 wherein the top wall portion has a rear edge and the rear edge extends from the front of the crown at least one third of the distance between the front and rear of the crown.

22. A headwear piece comprising:

a crown having a peripheral wall which extends around the head of a wearer, the crown having a front, a rear, a top and a bottom, the peripheral wall comprising a front wall portion that projects upwardly to define a forwardly facing surface and is contiguous with a top wall portion that defines an upwardly facing surface having a substantial are to protect a wearer's head; and a brim/bill projecting forwardly from the crown, the peripheral wall interrupted at the rear of the peripheral wall so that no part of the crown extends continuously around a wearer's head with the headwear piece in an operative position on a wearer's head, wherein no part of the headwear piece extends, or is extendable, continuously around the headwear piece on a wearer's head.

23. The headwear piece according to claim 22 wherein the crown has a peripheral shape as viewed from the top of the headwear piece and an opening, and the area of the opening is at least one fifth the area of the peripheral shape as viewed from the top of the headwear piece.

24. The headwear piece according to claim 22 wherein the top wall portion has a rear edge and the rear edge extends from the front of the crown at least one third of the distance between the front and rear of the crown.

25. The headwear piece according to claim 22 wherein the peripheral wall extends around the sides of a wearer's head to compressibly engage the rear of the wearer's head with the headwear piece in the operative position.

26. A headwear piece comprising:

a crown having a peripheral wall which extends around the head of a wearer, the crown having a front, a rear, a top and a bottom, the peripheral wall comprising a front wall portion that projects upwardly to define a forwardly facing surface and is contiguous with a top wall portion that defines an upwardly facing surface having a substantial are to protect a wearer's head; and a brim/bill protecting forwardly from the crown, the peripheral wall interrupted at the rear of the peripheral wall so that the peripheral wall does not extend continuously around a wearer's head with the headwear piece in an operative position on a wearer's head, wherein the crown comprises first and second spaced legs which project rearwardly and cooperatively and compressibly capture a wearer's head to maintain the headwear piece in an operative position on a wearer's head, the first and second spaced legs projecting rearwardly to first and second free ends that are not connected, or connectable, to each other at the rear of the headwear piece, wherein no part of the headwear piece extends, or is extendable, continuously around the headwear piece on a wearer's head.

27. A headwear piece comprising:

a crown having a peripheral wall which extends around the head of a wearer, the crown having a front, a rear, a top and a bottom, the peripheral wall comprising a front wall portion that projects upwardly to define a forwardly facing surface and is contiguous with a top wall portion that defines an upwardly facing surface having a substantial are to protect a wearer's head; and a brim/bill projecting forwardly from the crown, the peripheral wall interrupted at the rear of the peripheral wall so that the peripheral wall does not extend continuously around a wearer's head with the headwear piece in an operative position on a wearer's head, wherein the crown comprises first and second spaced legs which project rearwardly, wherein the first and second spaced legs are defined by a single, U-shaped piece.

* * * * *